US006376998B1

(12) United States Patent
Okamoto et al.

(10) Patent No.: US 6,376,998 B1
(45) Date of Patent: Apr. 23, 2002

(54) FEEDING DEVICE FOR DISCHARGE LAMP

(75) Inventors: Masashi Okamoto, Akashi; Tomohiro Yamamoto, Mimaji; Tomoyoshi Arimoto, Himeji; Yoshitaru Kondo, Takasago, all of (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/720,092

(22) PCT Filed: Apr. 19, 2000

(86) PCT No.: PCT/JP00/02537

§ 371 Date: Dec. 21, 2000

§ 102(e) Date: Dec. 21, 2000

(87) PCT Pub. No.: WO00/65885

PCT Pub. Date: Nov. 2, 2000

(30) Foreign Application Priority Data

Apr. 21, 1999 (JP) ..... 11-114269

(51) Int. Cl.[7] ..... H05B 37/02

(52) U.S. Cl. ..... 315/291; 315/94; 315/308; 315/246

(58) Field of Search ..... 315/94–99, 224, 315/225, 209 R, 219, 291, 307, 308, 246

(56) References Cited

U.S. PATENT DOCUMENTS 5,051,665 A * 9/1991 Garrison et al. ..... 315/291
5,055,742 A * 10/1991 Jurell et al. ..... 315/94
5,463,287 A * 10/1995 Kurihara et al. ..... 315/308
5,949,192 A * 9/1999 Kominami et al. ..... 315/94

FOREIGN PATENT DOCUMENTS

| | | |
|---|---|---|
| JP | 62-88295 | 4/1987 |
| JP | 5-42637 | 10/1993 |
| JP | 7-176391 | 7/1995 |
| JP | 10-116590 | 5/1998 |

* cited by examiner

*Primary Examiner*—Don Wong
*Assistant Examiner*—Wilson Lee
(74) *Attorney, Agent, or Firm*—Nixon Peabody LLP; David S. Safran

(57) ABSTRACT

To provide a power supply device for electric discharge lamps in which lamp extinguishing is completely prevented in high-pressure mercury vapor lamps with a comparatively large amount of mercury sealed within, is achieved through the use of a switchable connection from the connection state of a simulated arc discharge resistor (59) virtually equal to the arc discharge resistance of the high-pressure mercury vapor lamp to the connection state of simulated glow discharge resistors (59, 60) that have virtually 1/7 of the glow discharge resistance that is completed at the output terminal of the power supply device (2) for the electric discharge lamps in question. The simulated arc discharge resistor is connected to the power supply device for electric discharge lamps, and the simulated glow discharge current in the transient state, switched from the state of flow of simulated arc discharge current to the simulated glow discharge resistor, continues to be under 30% of the simulated arc discharge current for less than 10 μs and the duration until the current recovers to at least 70% of said simulated arc discharge current is less than 100 μs.

6 Claims, 14 Drawing Sheets

FEEDING DEVICE FOR DISCHARGE LAMP

BACKGROUND OF THE INVENTION

1. Field of Invention

The present invention concerns a power supply device for electric discharge lamps, for example, a power supply device for electric discharge lamps that turns on a high-luminance high-pressure mercury vapor lamp that is used as a light source for projectors.

2. Description of Related Art

Metal halide lamps and high-pressure mercury vapor lamps have been used as a high-luminance light source.

In recent years, high-pressure mercury vapor lamps in which the mercury vapor pressure has been raised to obtain desired luminance have been effective as light sources for projectors used in luminous flux control devices such as liquid crystals. The amount of mercury sealed in lamps has tended to increase.

Incidentally, the problem arises of a lamp extinguishing over the course of several seconds to dozens of seconds even after successful initiation by an igniter when a lamp is turned on as the amount of mercury sealed in lamps increases.

The inventors conducted empirical observations under various conditions and discovered that mercury condenses on the cathode and sticks during the cooling period when a lamp is extinguished.

This phenomenon can be briefly explained by stating that electrons are readily released from liquid mercury, as is well known, with the result being that arc release becomes possible at extremely low operation voltage of 15 volts to 20 volts, for example, when liquid mercury is present on a cathode.

If discharge should commence while liquid mercury sticks to a cathode, arc discharge would appear first, and mercury on a cathode would rapidly evaporate. At that time, as mercury on the cathode first evaporates, at those sections opposite the cathode, the discharge site gradually would shift toward the base of the cathode. Once mercury has completely evaporated from the cathode, including the base of the cathode, the arc discharge at low operation voltage terminates and it shifts to glow discharge.

The impedance between electrodes is low during arc discharge, but since it rises during glow discharge, comparatively high operation voltage must be supplied to maintain glow discharge. However, if the voltage output from a power supply device cannot accommodate the operation voltage that rapidly rises, the lamp extinguishes at the moment of shift to glow discharge.

Accordingly, the temperature at the cathode tip would rise if glow discharge can be maintained without extinguishing, and a supply of thermions would eventually become possible, at which point the discharge would shift to arc discharge and maintenance of a steady lighting state by the discharge lamp would become possible.

This problem of lamp extinguishing did not materialize much in the past because of the low amount of mercury used. Accordingly, any liquid mercury on a cathode during the period of igniter actuation could scatter and powerful glow discharge could be maintained due to the high voltage generated by the igniter after the end of arc discharge at low operation voltage.

Accordingly, maintenance of glow discharge by continuous actuation of the igniter even after liquid mercury on a cathode had scattered has been considered as well, but such a method would not be practical because the electrode would be depleted and the light tube would blacken.

The means of resolving the problem of mercury sticking to electrodes of high pressure mercury vapor lamps was proposed in Japanese Kokai Publication Hei-10-116590.

In this means, the cathode cooling rate after the lamp extinguishes is retarded in the course of gradual lamp cooling by raising the heat capacity of the cathode or in the vicinity thereof. By so doing, mercury condensation commences from the cathode or the inner surface of the light bulb, and the condensation/sticking of mercury to the cathode is prevented. Thus, even if much liquid mercury should remain in the cathode when the lamp is relit, discharge could easily shift to glow discharge so long as liquid mercury does not stick to the cathode.

However, the prevention of condensation/sticking of mercury on the cathode becomes difficult when the amount of mercury inclusion is increased in the method of raising the heat capacity in the vicinity of the cathode proposed in said gazette, and the sticking of mercury on the cathode cannot be prevented at all, especially if the lamp is set vertically so that the cathode is below and the anode is above. Specifically, the termination of arc discharge at low operation voltage becomes impossible in this method while the igniter is operating, and the operation voltage required for glow discharge after mercury has been completely depleted from the cathode increasingly rises because of the inclusion of large amounts of mercury. This raises the probability of the lamp extinguishing.

In this connection, the vertical lamp arrangement is useful in that it permits the location of devitrification, which can happen within a lamp inclusion body, to be limited to harmless sites depending on where the light is output, and installation so that the cathode is below and the anode is above is useful in that it prevents flickering, which is important depending on the conditions of lamp usage.

SUMMARY OF THE INVENTION

In light of the various problems, the object of the present invention is to provide a power supply device for electric discharge lamps in which the extinguishing of a high pressure mercury vapor lamp with a comparatively high amount of mercury inclusion can be completely prevented when mercury is completely evaporated from the cathode.

The present invention uses the following means for resolving the above-noted problems.

The first means provides a power supply device for electric discharge lamps that lights high pressure mercury vapor lamps in which a cathode and anode are disposed in a discharge space enclosed by an inclusion body and in which noble gas as well as 0.15 mg or more of mercury per 1 $mm^3$ of said discharge space are sealed, wherein a switchable connection from the connection state of a simulated arc discharge resistor virtually equal to the arc discharge resistance during arc discharge of the high-pressure mercury vapor lamp to the connection state of simulated glow discharge resistors that have virtually 1/7 of the glow discharge resistance during glow discharge of the high-pressure mercury vapor lamp is completed at the output terminal of the power supply device for electric discharge lamps in question, the simulated arc discharge resistor is connected to the power supply device for electric discharge lamps in question, and the simulated glow discharge current in the transient state of switch from the state of flow of simulated arc discharge current to the simulated glow discharge resistor continues to be under 30% of the simulated arc discharge current for less than 10 $\mu$s and the duration until the current recovers to at least 70% of said simulated arc discharge current is less than 100 $\mu$s.

The second means provides the power supply device for electric discharge lamps of the first means that has a function of controlling the lamp current so that the lamp power reaches a predetermined rated power, and a function of controlling the lamp current so that the lamp current does not exceed a predetermined maximum current, wherein the function of controlling the lamp current so that the lamp current does not exceed the maximum current takes priority over the function of controlling the lamp current so that the lamp power reaches the rated power, and a control function is provided so that the duration of control so as to restore the current to at least 70% of the simulated arc discharge current is more than 50 ms upon switching to the simulated glow discharge resistor and so that this duration will tolerate the rated power to be exceeded.

The third means provides a power supply device for electric discharge lamps that lights high pressure mercury vapor lamps in which a cathode and anode are disposed in a discharge space enclosed by an inclusion body and in which noble gas, 0.15 mg or more of mercury per 1 $mm^3$ of the discharge space and $1\times10^{-7}$ moles of halogen per 1 $mm^3$ of the discharge space are sealed in said discharge space, wherein a switchable connection from the connection state of a simulated arc discharge resistor virtually equal to the arc discharge resistance during arc discharge of said high-pressure mercury vapor lamps to the connection state of simulated glow discharge resistors that are virtually equal to the glow discharge resistance during glow discharge of said high-pressure mercury vapor lamp is completed at the output terminal of the power supply device for electric discharge lamps in question. Vag' represents the output voltage of the power supply device for electric discharge lamps and Iag' represents the simulated glow discharge current upon switching to the simulated glow discharge resistor from the state of flow of simulated arc discharge current by connecting the simulated arc discharge resistor to the power supply device for electric discharge lamps in question. The device in which the cathode surface area is represented by Sc ($mm^2$) has the following characteristics.

(1) The simulated glow discharge current in the steady state is Iag'/0.14×Sc (A)

(2) The output voltage in the steady state is Vag'/180 (V)

(3) The time required for the output voltage Vag' to reach 90% of the voltage in the steady state is time $\tau$*170 ($\mu$s).

The fourth means provides said power supply device for electric discharge lamps of any one of means 1 to 3 that is provided with a variable output direct current power source that inputs direct current voltage and then applies variably-controlled output voltage to the high-pressure mercury vapor lamps via a smoothing capacitor, wherein the capacitance of the smoothing capacitor is increased during transition to arc discharge following the end of glow discharge.

DETAILED DESCRIPTION OF THE INVENTION

The first implementation mode of the present invention is explained using FIGS. 1 to 6.

Figure 1:
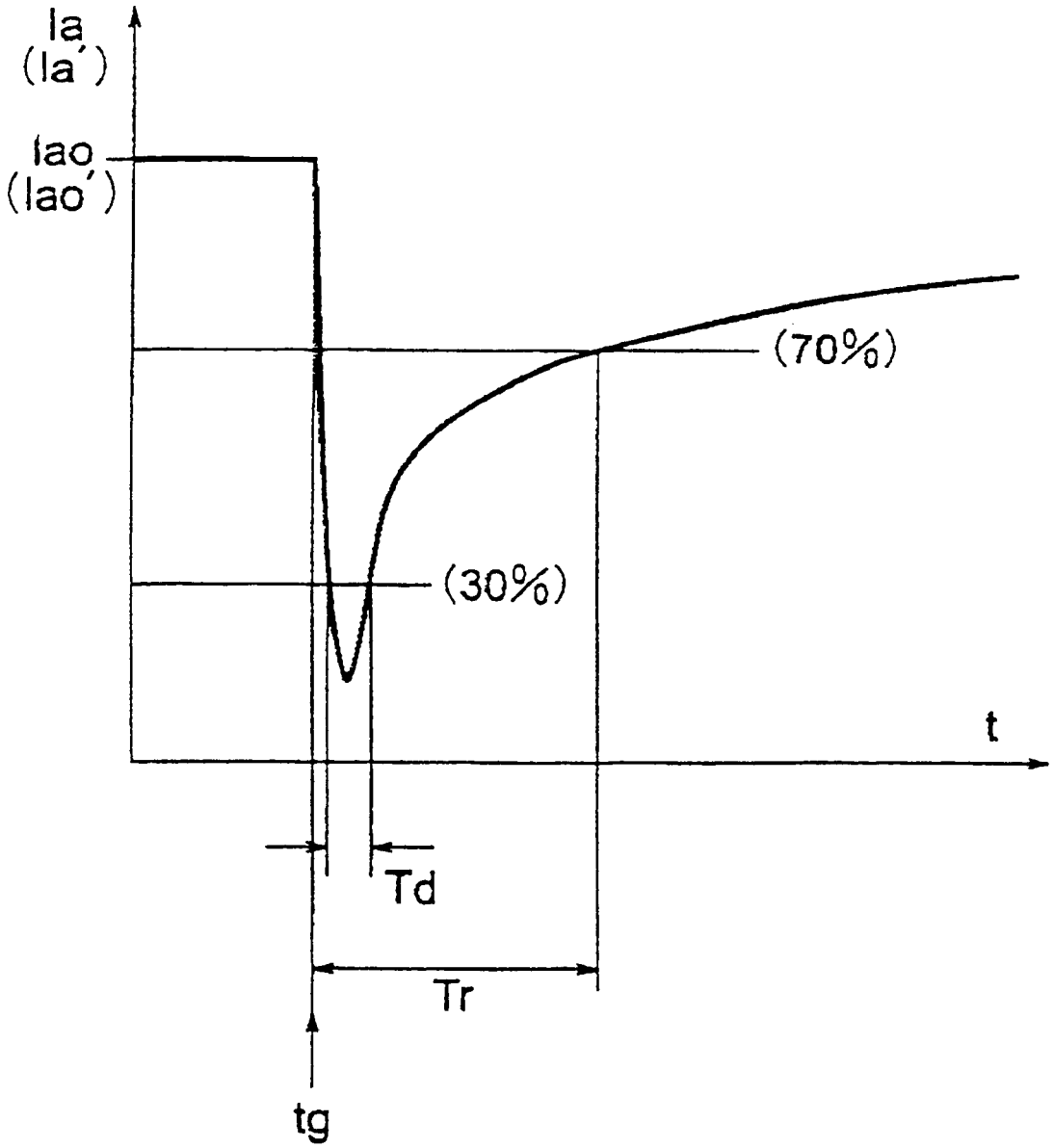
FIG. 1 is a graph that shows the periodic changes in the discharge current during transition from initial arc discharge of a high-pressure mercury vapor lamp to glow discharge and from glow discharge to arc discharge.

FIG. 1 is a diagram that shows the periodic changes in the discharge current during transition from initial arc discharge of a high-pressure mercury vapor lamp to glow discharge and from glow discharge to arc discharge.

The principle of preventing extinguishing of the lamp pursuant to the present invention is explained first using the diagrams.

When discharge of a high-pressure mercury vapor lamp with a comparatively high amount of sealed mercury commences while liquid mercury is stuck on the cathode, arc discharge appears and mercury rapidly evaporates from the cathode. At time tg shown in the diagram, arc discharge ends at low operation voltage, at which point the mercury on the cathode has been completely depleted and discharge transits to glow discharge. However, lamp current Ia rapidly decreases since the impedance between electrodes rapidly rises at time tg and the lamp extinguishes at that point.

The inventors were able to create a power supply device that does not extinguish as a result of various improvements to the power supply device.

The results of studies using the test circuit discussed below revealed that prescribed conditions must be satisfied to prevent extinguishing by the power supply device.

Figure 2:
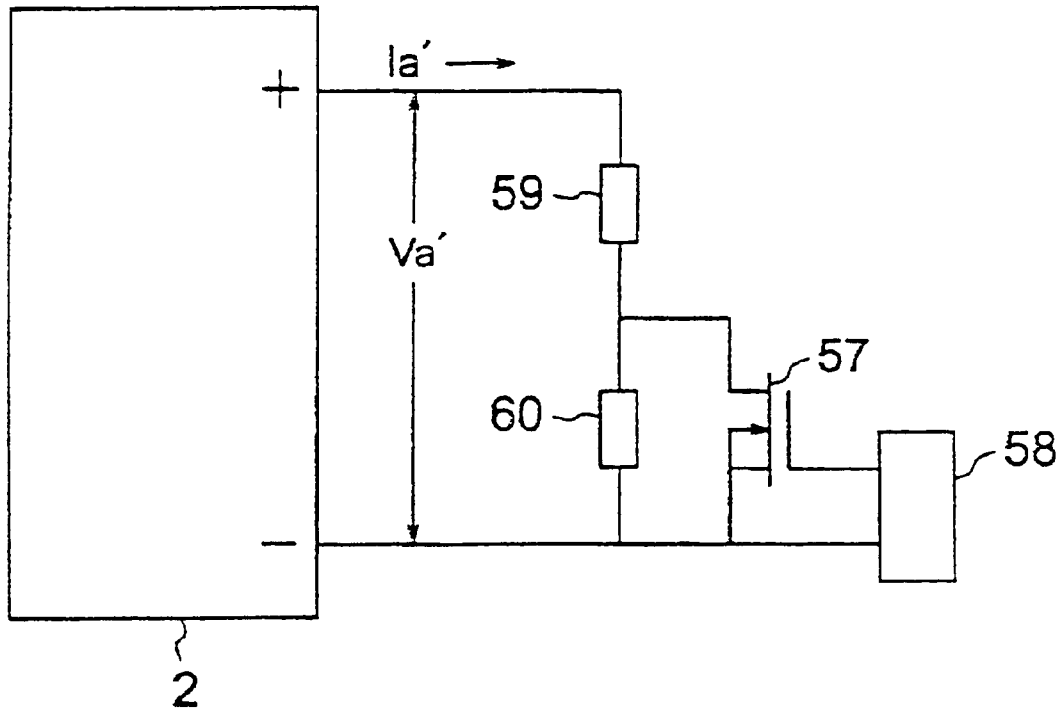
FIG. 2 is a diagram that shows a test circuit to identify the power supply device for electric discharge lamps used in the high-pressure mercury vapor lamps in the first implementation mode.

The test circuit is explained first. FIG. 2 is a diagram that shows a test circuit to identify the power supply device for electric discharge lamps used in high-pressure mercury vapor lamps that have a comparatively high amount of mercury sealed within, 0.15 mg or more per 1 $mm^3$ volume of the discharge space of a high-pressure mercury vapor lamp.

The high-pressure mercury vapor lamps used in this implementation mode have an arc discharge resistance during arc discharge of 5ζ and a glow discharge resistance during glow discharge of 300ζ.

In the diagram, reference number 2 denotes a power supply device for electric discharge lamps that is the object of evaluation to determine whether or not lamp extinguishing can be effectively prevented. Reference numbers 59, 60 denote resistors of 5ζ and 38ζ resistance, respectively, that are connected in series to the output terminal of power supply device 2 for electric discharge lamps. Reference number 57 denotes a FET that shorts and opens resistor 60. Reference number 58 denotes a gate drive circuit that switches FET 57.

Here, resistor 59 is set to resistance roughly equal to the 5ζ arc discharge resistance during the arc discharge so that the current flowing through resistor 59 is roughly equal to the current flowing during arc discharge when liquid mercury is present on the cathode of an actual high-pressure mercury vapor lamp, and resistor 59+resistor 60 are set to resistance equal to about 1/7 of the 300ζ glow discharge resistance during glow discharge of said high-pressure mercury vapor lamp. The resistance of resistor 59+resistor 60 is set at about 1/7 of the glow discharge resistance in order to distinctly discriminate if the power supply device for electric discharge lamps that is the object of evaluation has satisfied the prescribed conditions.

In the operation of this test circuit, arc discharge when liquid mercury is present on the cathode of a high-pressure mercury vapor lamp is simulated when only resistor 59 is connected with FET 57 ON. Next, gate drive circuit 58 is actuated, FET 57 is rapidly turned OFF and the state transits to serial connection of resistor 59 and resistor 60. As a result, mercury on the cathode is completely depleted and transition to glow discharge is simulated. By observing the response of these two states, it becomes possible to assess whether or not the performance of an actual power supply device for electric discharge lamps satisfies the conditions recommended in accordance with the present invention.

The conditions that should be satisfied when a power supply device that does not extinguish is tested using this test circuit are explained next.

The conditions are explained using FIG. 1. Whether or not duration Td exists during which simulated glow lamp current during rapid increase of impedance of a high-pressure mercury vapor lamp is under 30% of the simulated lamp current Iao' immediately preceding rapid increase, the continuous duration TD would be under 10 μs. Furthermore, the conditions would be controlled so that the duration Tr would be under 100 μs before the simulated glow lamp current during rapid increase of impedance of a high-pressure mercury vapor lamp recovers to at least 70% of the simulated lamp current Iao' immediately preceding rapid increase. The empirical discovery was made that lamp extinguishing can be prevented when a power supply device satisfies these conditions. Furthermore, the fact was clarified that lamp extinguishing could be prevented when lighting it under such conditions even in the worst cases in which a lamp is set vertically with the cathode below and the anode above.

When the lamp current is cut off or reduced, the discharge plasma decreases and is dissipated before long, but since dissipation of discharge plasma can be avoided if the lamp current recovers to the prescribed size before the discharge plasma is dissipated, there must be no duration TD during which the simulated glow lamp current during rapid increase of impedance of a high-pressure mercury vapor lamp is under 30% of the simulated lamp current Iao' immediately preceding rapid increase to ensure that the lamp does not extinguish during transition to glow discharge, or if duration TD does exist, it must continuously be less than 10 μs.

Even if there are a plurality of durations TD, in which the simulated glow lamp current during rapid increase of impedance of a high-pressure mercury vapor lamp is under 30% of the simulated lamp current Iao' immediately preceding rapid increase of the impedance, so long as each duration is under 10 μs, their sum may exceed that figure without any problem. Of course, the absence of duration TD during which it is under 30% would be ideal, but the concern could be attained with a reserve if duration TD is under 8 μs, and a duration under 5 μs would be still more desirable.

Furthermore, by controlling duration Tr so that it is under 100 μs before the simulated glow lamp current during rapid increase of impedance of a high-pressure mercury vapor lamp recovers to at least 70% of the simulated lamp current Iao' immediately preceding rapid increase, thermion release can be rapidly activated to complete a rapid shift to arc discharge following a shift to glow discharge.

Furthermore, it is preferable to have a short duration Tr until the simulated glow lamp current during rapid increase of impedance of a high-pressure mercury vapor lamp recovers to at least 70% of the simulated lamp current Iao' immediately preceding rapid increase, and said issue could be attained with a reserve if it is under 80 μs, and a duration under 60 μs would be still more desirable. In addition, the issue could be attained with a reserve if the extent of recovery of the lamp current were to at least 85% of the simulated lamp current Iao' immediately preceding rapid increase of the impedance of a high-pressure mercury vapor lamp.

The power supply device for electric discharge lamps, in accordance with the invention, must be specified using a test circuit because the individual elements comprising a power supply device for electric discharge lamps may be adjusted or modified to prevent extinguishing of a high-pressure mercury vapor lamp, and it is important whether or not the ultimately-modified power supply device for electric discharge lamps satisfies the prescribed conditions.

Figure 3:
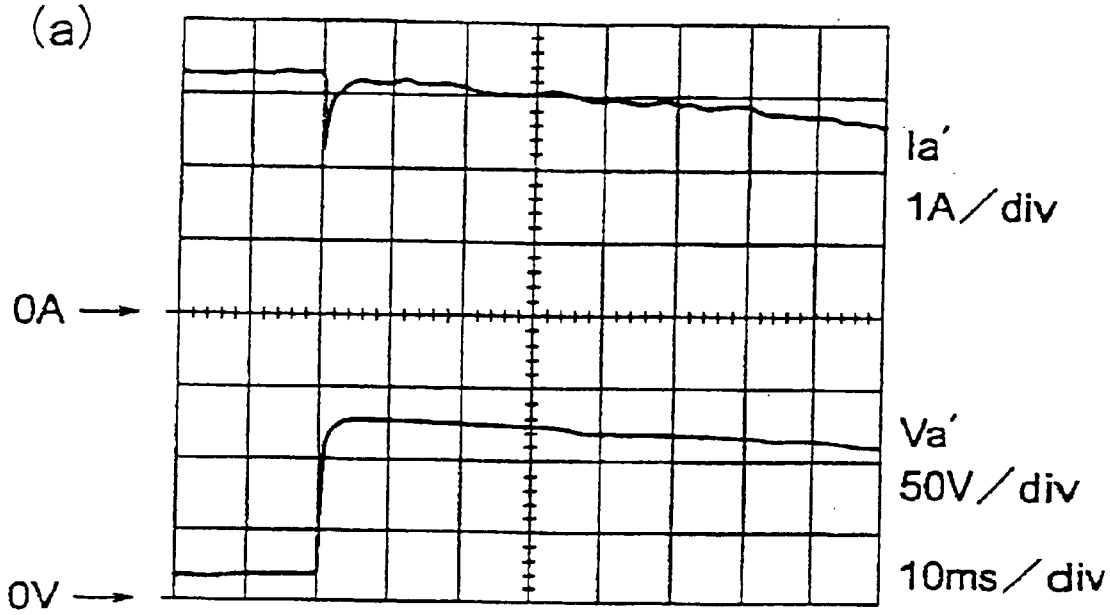
FIGS. 3(*a*) and 3(*b*) are graphs that show simulated lamp current I' and simulated lamp voltage V' in the test circuit shown in FIG. 2 of a power supply device for electric discharge lamps that satisfies prescribed conditions and does not extinguish.
Figure 3:
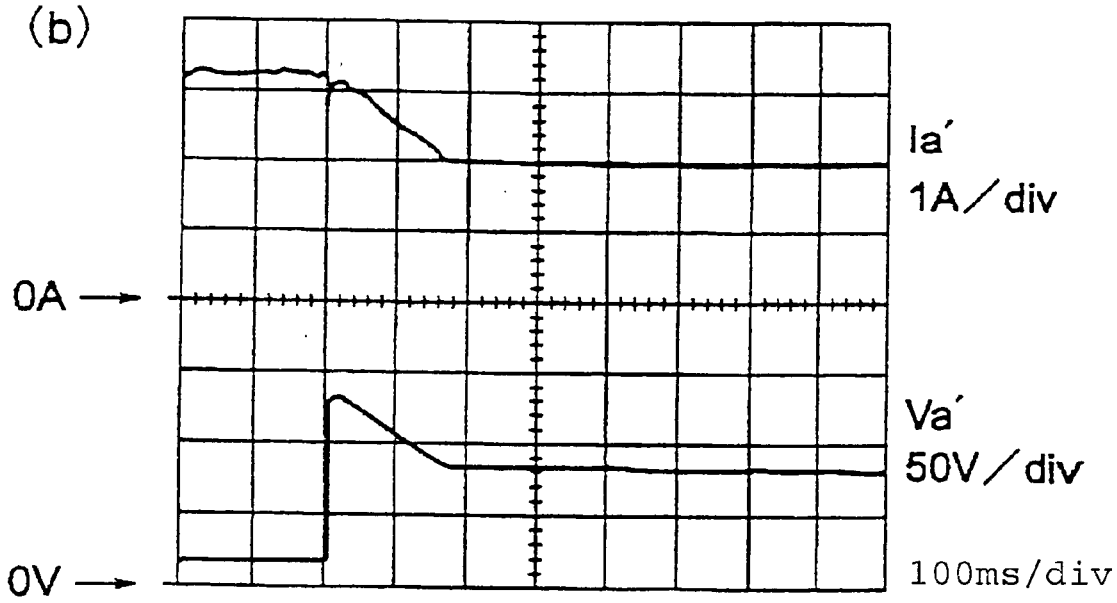

FIG. 3 are graphs that show simulated lamp current Ia' and simulated lamp voltage Va' in the test circuit shown in FIG. 2 of a power supply device for electric discharge lamps that satisfies prescribed conditions and does not extinguish. Here, FIG. 3(*a*) and FIG. 3(*b*) show the same phenomena, but the periodic scale differs.

Figure 4:
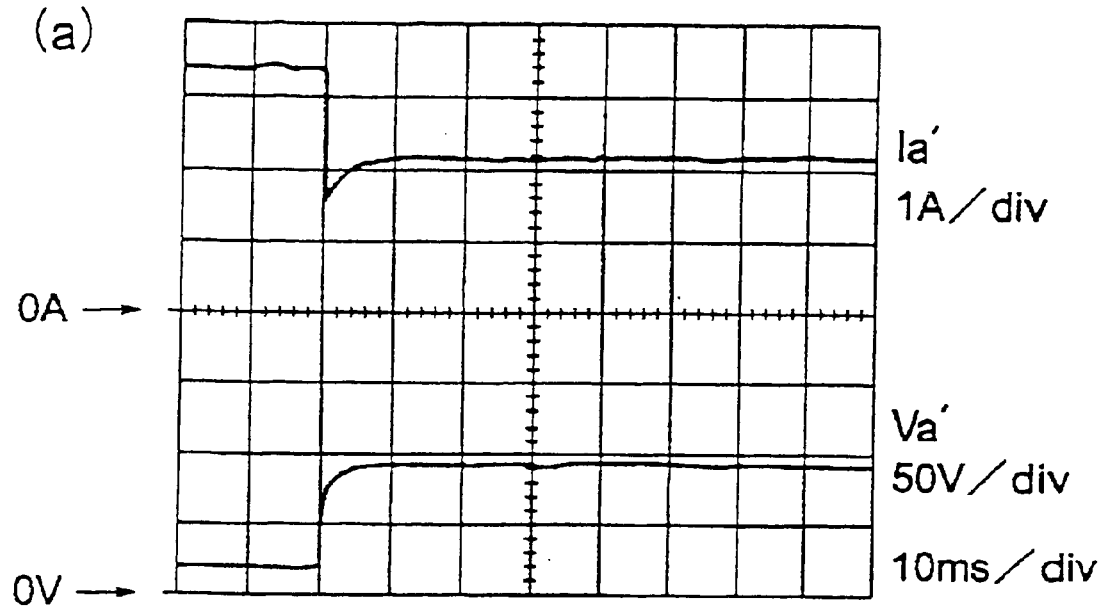
FIGS. 4(*a*) and 4(*b*) are graphs that show simulated lamp current I' and simulated lamp voltage V' in the test circuit shown in FIG. 2 of a power supply device for electric discharge lamps that satisfies prescribed conditions and extinguishes.
Figure 4:
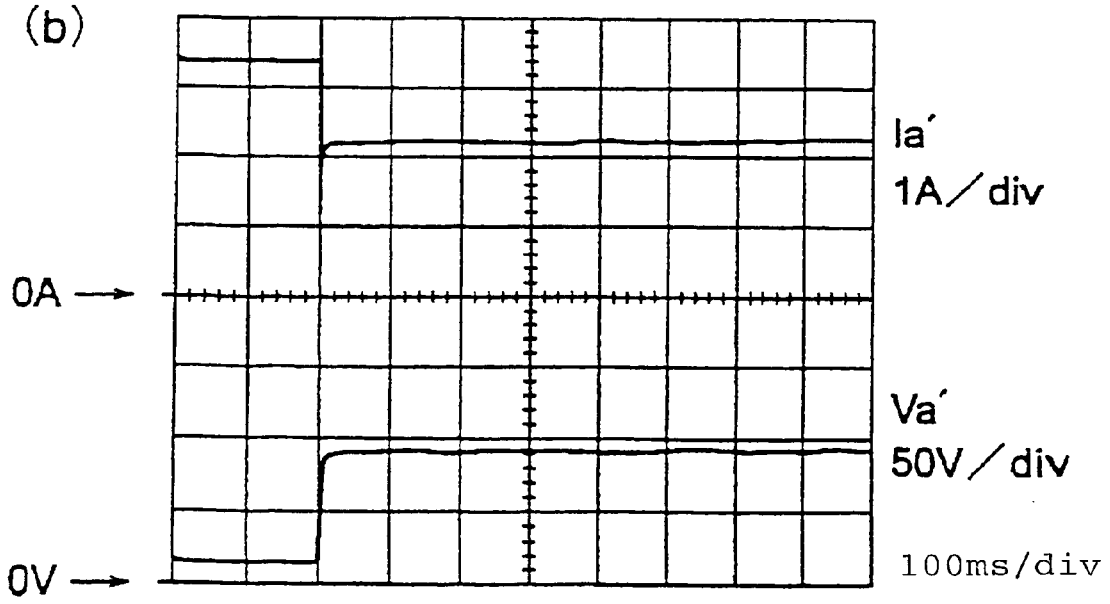

FIG. 4 are graphs that show the relation between simulated lamp current Ia' and simulated lamp voltage Va' in the test circuit shown in FIG. 2 of a power supply device for electric discharge lamps that satisfies prescribed conditions and extinguishes. Here, FIG. 4(*a*) and FIG. 4(*b*) show the same phenomena, but the periodic scale differs.

The oscilloscope was subjected to smoothing processing to facilitate contrasting of FIGS. 3 and 4 with FIGS. 8 and 10 discussed below.

As stated above, by testing the power supply device for electric discharge lamps that is the object of evaluation using the test circuit shown in FIG. 2, a power supply device for electric discharge lamps that does not extinguish the lamp could be discovered through various modifications based on the test results shown in FIGS. 3 to 4.

In this implementation mode, the arc discharge resistance during arc discharge of an actual high-pressure mercury vapor lamp is assumed to be Ra while the glow discharge resistance during glow discharge is assumed to be Rb. Lamp extinguishing could be effectively prevented by using a power supply device for the high-pressure mercury vapor lamps that satisfies two conditions. The first is that the duration during which the simulated glow discharge current in the transient state of switch from the state of flow of simulated lamp current Iao' to resistors (59+60) is under 30% of simulated lamp current Iao' is continuously less than 10 $\mu$s as a result of connecting resistor 59 to the power supply device for electric discharge lamps that is the object of evaluation when connection to the output terminal of the power supply device for electric discharge lamps that is the object of evaluation has been switched from connection of resistor 59 that is virtually equal to arc discharge resistance Ra to resistors (59+60) that have virtually 1/7 of glow discharge resistance Rb. The second is that the duration would be under 100 $\mu$s before the current recovers to at least 70% of the simulated lamp current Iao'.

The power supply device for electric discharge lamps in the implementation mode of the present invention is explained next using FIGS. 5 and 6.

Figure 5:
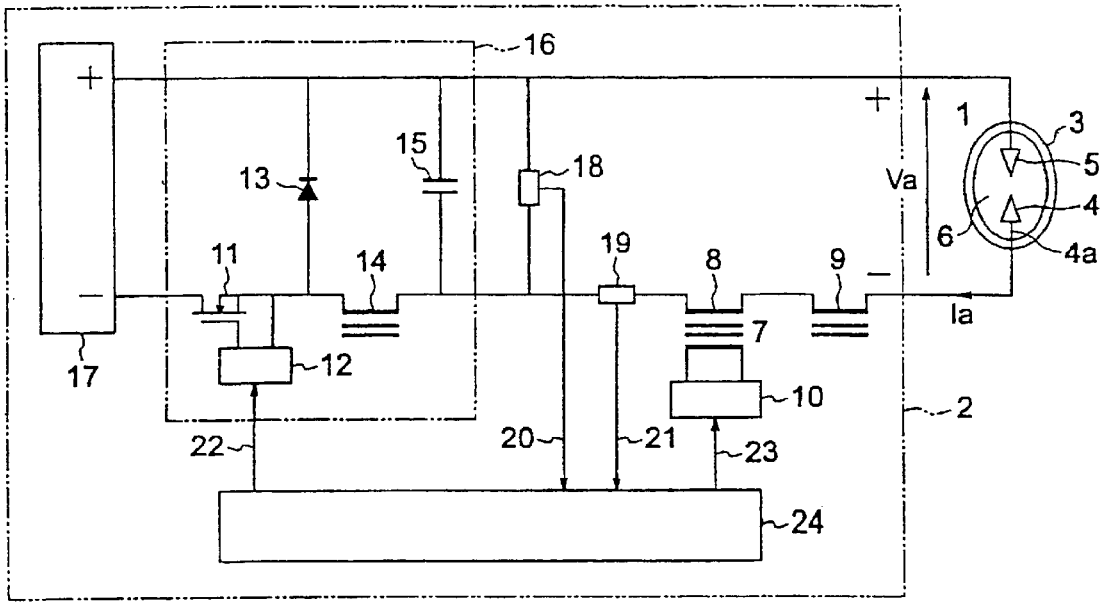
FIG. 5 is a diagram that shows one example of the structure of a power supply device for electric discharge lamps in a first and second implementation mode.

FIG. 5 is a diagram that shows one example of the structure of a power supply device for electric discharge lamps. In the figure, reference number 17 denotes a DC power source that provides voltage from DC power source 17 to step-down chopper 16. Step-down chopper 16 primarily comprises switch device 11, gate drive circuit 12, diode 13, inductor 14 and smoothing capacitor 15. A device (not illustrated) that converts a commercial AC power source into direct current using rectifier diodes, diode bridges and smoothing capacitors, a power source module that has a function of inhibiting harmonic current or a battery can be used as the DC power source 17.

Reference number 1 denotes a high-pressure mercury vapor discharge lamp having a discharge space 6 within lamp inclusion body 3 in which is sealed a comparatively large amount of mercury and in which cathode 4 and anode 5 are disposed opposite each other. Reference number 18 denotes a voltage detector constructed using differential voltage resistors that detects voltage Va that is applied to high-pressure mercury vapor discharge lamp 1, and reference number 19 denotes a current detector constructed using shunt resistors and CT, etc., that detects current Ia flowing to high-pressure mercury vapor discharge lamp 1. Reference number 7 denotes an igniter inserted between step-down chopper 16 and high-pressure mercury vapor discharge lamp 1 to create discharge breakdown of sealed gas between cathode 4 and anode 5 when high-pressure mercury vapor discharge lamp 1 commences lighting. Igniter 7 basically is constructed by transformer 8 that has a large primary-to-secondary winding ratio to generate a high-voltage pulse series of several kV to several dozen kV. Reference number 9 denotes a coil that is inserted between step-down chopper 16 and discharge lamp 1. Reference number 24 denotes a power supply device control circuit that provides gate drive signal 23 to gate drive circuit 10 of igniter 7 and that inputs lamp voltage signal 20 that was detected by voltage detector 18 as well as lamp current signal 21 that was detected by current detector 19. Gate drive signal 22 is supplied to gate drive circuit 12 of switch device 11 based on lamp voltage signal 20 and lamp current signal 21 so as to control switching of switch device 11.

The diagram shows an example in which power supply device control circuit 24 supplies gate drive signal 23 to gate drive circuit 10, but there are cases in which gate drive signal 23 would be rendered unnecessary depending on the form of igniter 7.

Figure 6:
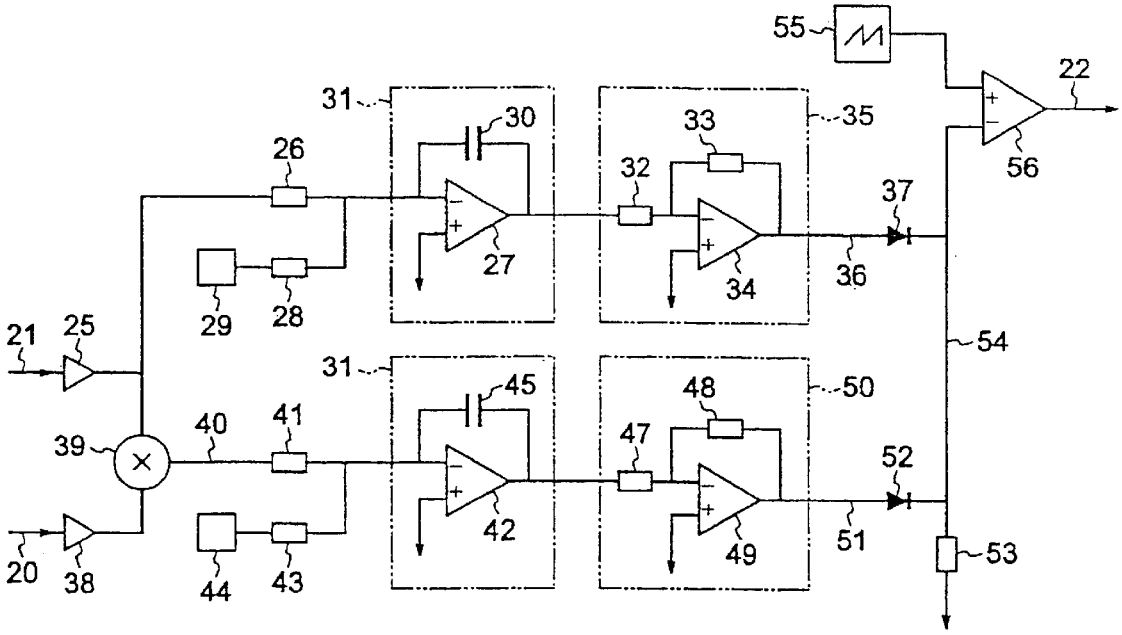
FIG. 6 is a diagram that shows one example of the structure of power supply device control circuit 24 shown in FIG. 5.

FIG. 6 is a diagram that shows one example of the structure of power supply device control circuit 24 shown in FIG. 5.

Lamp current signal 21 and lamp voltage signal 20 that were detected in the diagram are assumed to have positive polarity, and are optionally input to the power supply device control circuit 24 in question via buffer 25 and buffer 38, respectively.

Lamp current signal 21 is input to error integrator 31 comprising operational amplifier 27 and substrate 30 via resistor 26. On the other hand, output from maximum current signal generator 29 assumed to have negative polarity is input to operational amplifier 27 via resistor 28. The difference between the current set by maximum current signal generator 29 and lamp current signal 21 is integrated by capacitor 30 and output from error integrator 31. The output from error integrator 31 is output to overcurrent signal 36 via inverter 35 comprising resistor 32, resistor 33, operational amplifier 34.

On the other hand, lamp current signal 21 is combined with lamp voltage signal 20 by operator 39 to create power signal 40 which is input via resistor 41 to error integrator 46 comprising operational amplifier 42 and capacitor 45. In addition, the output from rated power signal generator 44 assumed to have negative polarity is input to operational amplifier 42 via resistor 43, and the difference in power between power signal 40 from error integrator 46 and the power determined by rated power signal generator 44 is integrated by capacitor 45 and then output.

The output from error integrator 46 is output as overcurrent signal 51 via inverter 50 comprising resistor 47, resistor 48, and operational amplifier 49.

Overcurrent signal 36 and overcurrent signal 51 are pulled down by resistor 53 via diode 37 and diode 52, respectively, with the result that the higher signal of either overcurrent signal 36 or overcurrent signal 51 is output to resistor 53 as step-down chopper control signal 54.

Overcurrent signal 36 becomes the higher signal when lamp current signal 21 is greater than a power value determined by maximum current signal generator 29, while overcurrent signal 51 becomes the higher signal when power signal 40 is greater than a power value determined by rated power signal generator 44. Accordingly, overcurrent signal 36 and the larger of the overcurrent signals appears preferentially in resistor 53. Step-down chopper control signal 54 compares the output signals of saw-tooth wave generator 55 by comparator 56. A high level signal when step-down chopper control signal 54 is smaller than the output signal of saw-tooth wave generator 55 or a low level signal when step-down chopper control signal 54 is greater than the output signal of saw-tooth wave generator 55 is output to gate drive circuit 12 of switch device 11 as gate drive signal 22.

If logic of gate drive circuit 12 is designed so that switch device 11 turns ON when gate drive signal 22 is at a high level, feedback control is instituted so that lamp current signal 21 would match the current determined by maximum current signal generator 29 when overcurrent signal 36 is the higher of overcurrent signal 36 or overcurrent signal 51, or conversely so that power signal 40 would match the power determined by rated power signal generator 44 when overcurrent signal 51 is the higher since the duration during which gate drive signal 22 is at the high level becomes shorter as step-down chopper control signal 54 rises.

As a result, power supply device 2 for electric discharge lamps with the function of controlling lamp current Ia so that lamp power Pa would become predetermined rated power Pas, and with the function of controlling lamp current Ia so that lamp current Ia would not exceed predetermined maximum current Ias can be realized in which the function of controlling lamp current Ia so that said maximum current Ias would not be exceeded takes priority over the function of controlling lamp current Ia so that lamp power Pa would become said rated power Pas.

For example, resistor 26 could be set at a low resistance value and/or capacitor 30 could be set at a small electrostatic capacitance value while the response of error integrator 31 in order to control maximum current Ias could be set at a high speed to implement the invention in this implementation mode. If adequate results are not attained by these steps alone, the inductance on the secondary side of transformer 8 of igniter 7 could be increased, coil 9 could be added or both could be completed. Of course, the operating frequency of step-down chopper 16, specifically, the oscillation frequency of saw-tooth wave generator 55, must be high enough to support the high speed control required for maximum current Ias. Reducing the electrostatic capacitance of smoothing capacitor 15 in a range such that ripples of step-down chopper 16 does not become excessive would be useful.

FIG. 5 and FIG. 6 are presented to explain the basic structure of the power supply device for electric discharge lamps pursuant to the present invention, but additional components or additional circuits such as protective circuits or noise filters may be added to ensure safe circuit operation or safe unit operation as required in the actual implementation, or means such as circuit simplification may also be necessary. In particular, inverters 35 and 50 were added to simplify the explanation, but these may be omitted.

A second implementation mode of the invention of this claim is explained using FIGS. 5 to 10.

This implementation mode concerns a power supply device for electric discharge lamps with functions added to more reliably prevent extinguishing of the power supply device for electric discharge lamps obtained in the first implementation mode.

Figure 7:
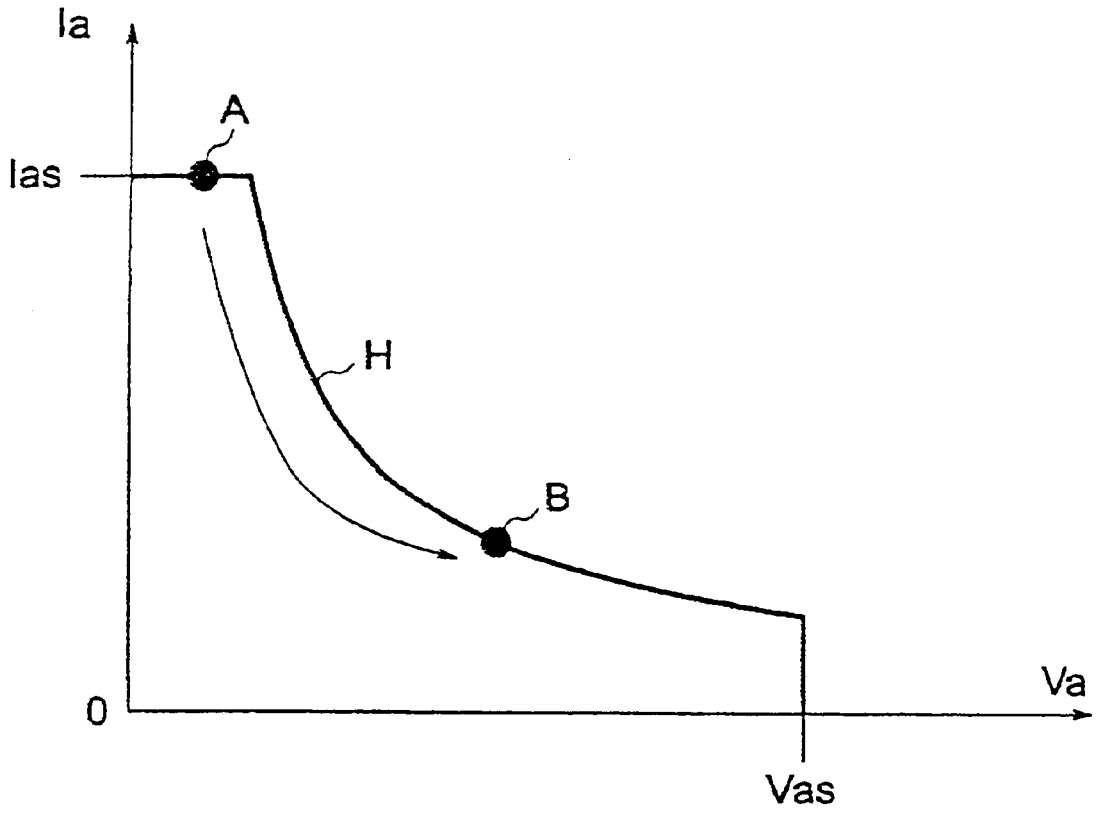
FIG. 7 is a plot of the characteristics of lamp current Ia and lamp voltage Va of a high-pressure mercury vapor lamp.

Lamp current Ia is controlled so that lamp power Pa becomes predetermined rated power Pas even if the lamp voltage Va should fluctuate accompanying change of the impedance between electrodes in the power supply device for mercury vapor lamps shown in FIG. 7. At that time, a very large lamp current Ia must flow to attain rated power Pas if lamp voltage Va is very low, but lamp current Ia is controlled so that lamp current Ia does not exceed predetermined maximum current Ias to prevent breakdown of the circuit elements installed in the actual power supply device. This function takes priority over controlling lamp current Ia so that lamp power Pa would become predetermined rated power Pas. Furthermore, the same diagram shows that maximum voltage Vas is determined, but this is a restriction to ensure that the required maximum limitation voltage is not exceeded to ensure safety during no-load switching. Based on the results, the voltage current characteristics of general power supply devices for electric discharge lamps basically form the hyperbola H shown in FIG. 7.

Figure 8:
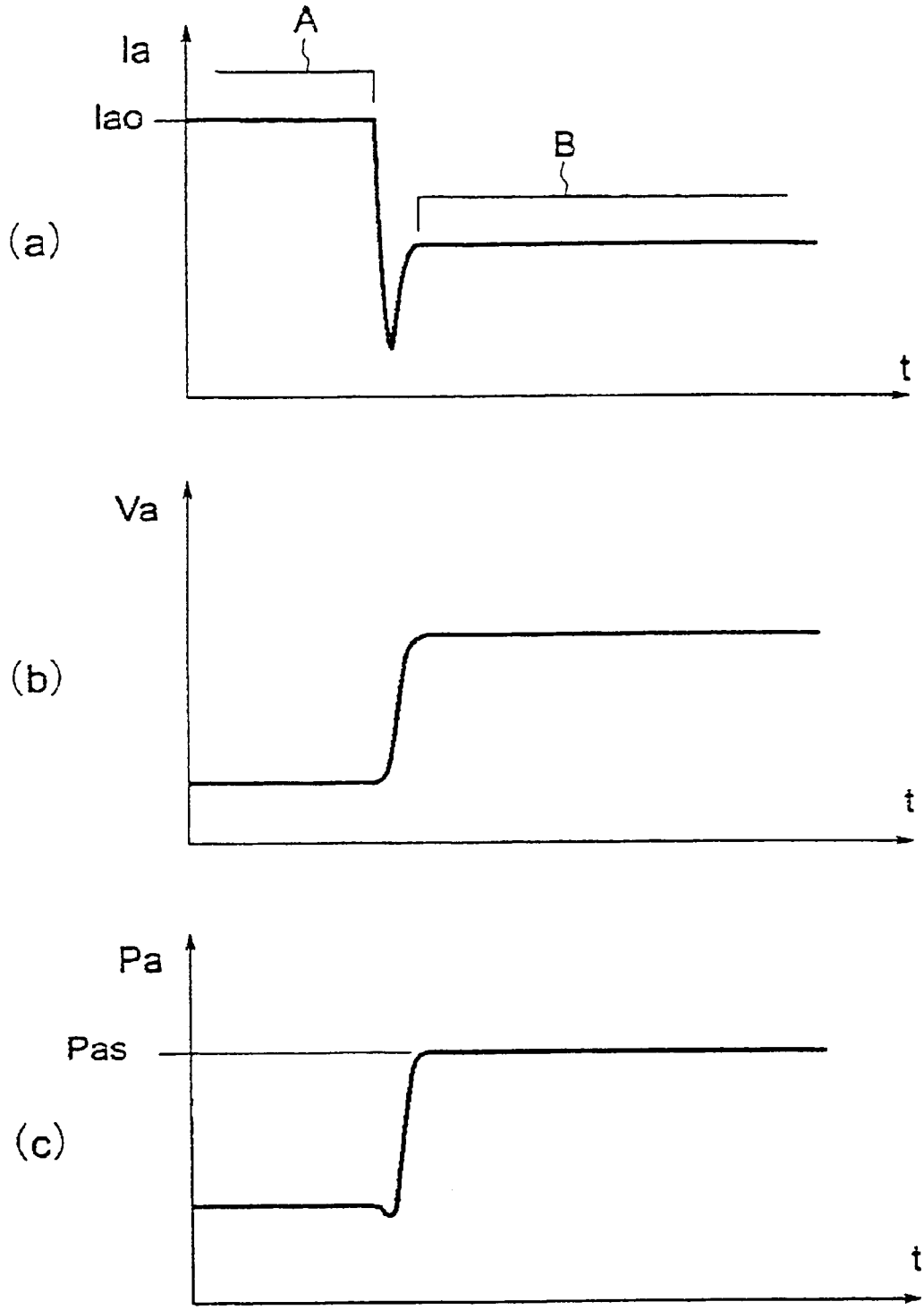
FIGS. 8(*a*)–8(*c*) are graphs that show the periodic course of lamp current Ia, lamp voltage Va and lamp power Pa of a high-pressure mercury vapor lamp.

FIGS. 8(*a*), (*b*), (*c*) are diagrams showing the periodic courses of lamp current Ia, lamp voltage Va and lamp power Pa during this period.

When a high-pressure mercury vapor lamp with a comparatively large amount of mercury sealed within is lit by a common power supply device for electric discharge lamps, the arc discharge when liquid mercury is present on the cathode immediately after lighting would be at point A in FIG. 7 since the impedance between electrodes is low enough. This is a state in which said lamp current Ia is controlled so as not to exceed predetermined maximum current Ias. Rated power is not reached in this state. Next, mercury is completely evaporated from the cathode and the state transits to glow discharge. The impedance between electrodes rises and lamp voltage Va rapidly increases. Accordingly, the state transits from point A to point B along the voltage-current characteristic curve H in FIG. 7, but lamp current Ia is greater than lamp current Iao immediately before the rapid increase in impedance of the high-pressure mercury vapor lamp, as shown in FIG. 8(*a*), and falls, presenting the possibility of the lamp extinguishing.

Thus, to avoid such a state, it passes through the range above voltage-current characteristic curve H rather than along the voltage-current characteristic curve H shown in FIG. 7, specifically, through the excess power range. The conditions pertaining to the method of passage through the excess power range can be determined using the test circuit shown in FIG. 2 just as before, specifically, a test circuit that switches between resistance roughly equal to the lamp impedance during arc discharge and resistance equal to roughly 1/7 of the lamp impedance during glow discharge.

Figure 9:
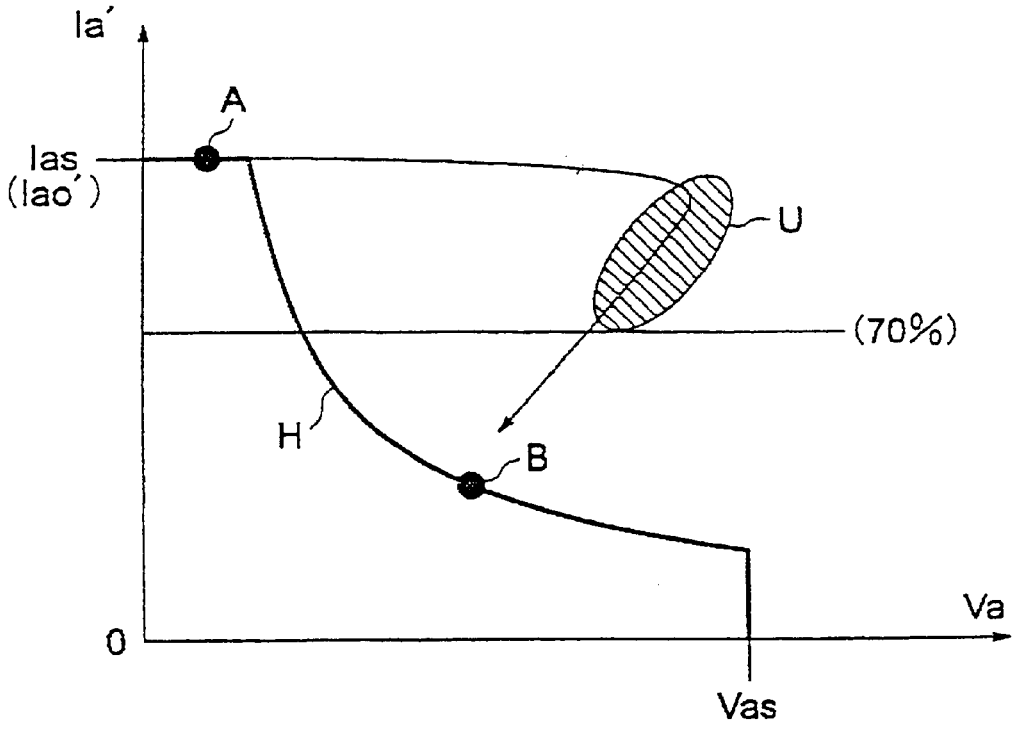
FIG. 9 is a plot of the characteristics of simulated lamp current Ia', and simulated lamp voltage Va' of a high-pressure mercury vapor lamp pursuant to the second implementation mode.

FIG. 9 is a diagram showing the intended voltage current characteristics in the invention pursuant to this implementation mode.

When transiting from point A to point B, as shown by the voltage-current characteristics in this diagram, the state persists for a prescribed period in range U in which the current is at least 70% of simulated lamp current Iao' at point A rather than transiting along voltage-current characteristic curve H, followed by transit to point B.

Figure 10:
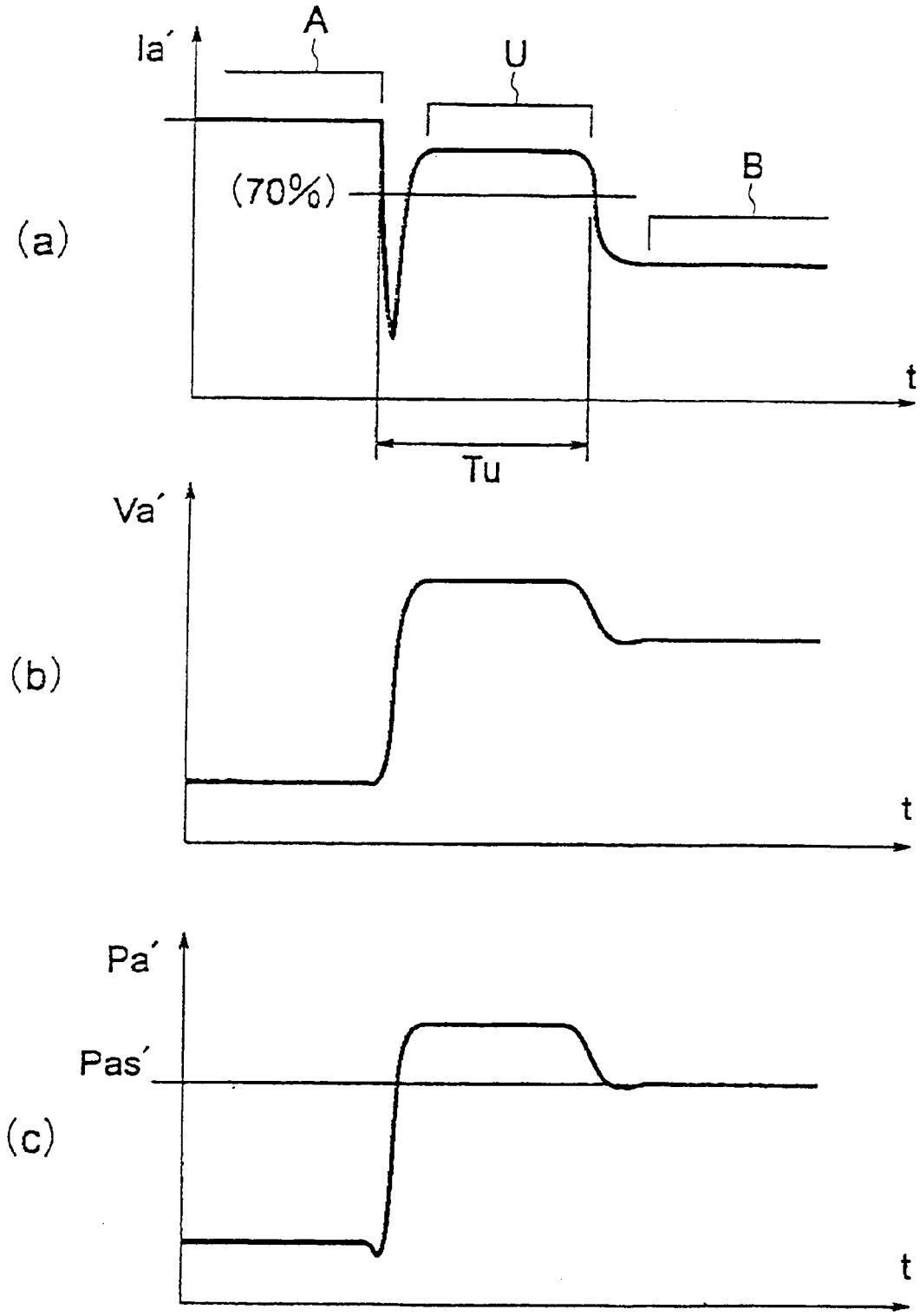
FIGS. 10(*a*)–10(*c*) are graphs that show the periodic course of simulated lamp current Ia', lamp voltage Va', and lamp power Pa' of a high-pressure mercury vapor lamp pursuant to the second implementation mode.

FIGS. 10(*a*)–(*c*) are graphs showing the periodic courses of simulated lamp current Ia', simulated lamp voltage Va' and simulated lamp power Pa' during this period.

The issue of the present invention could be more reliably attained by adding a function to the power supply device for electric discharge lamps pursuant to this implementation mode wherein the duration of residence in range U in which the current is at least 70% of simulated lamp current Iao' at point A exceeds 50 ms.

Thermion release must be rapidly activated to maintain discharge, but prolonging duration Tu to control the current so as to recover to at least 70% of simulated lamp current Iao' immediately preceding the rapid increase in impedance of the high-pressure mercury vapor lamp would be useful in preventing lamp extinguishing. A duration above 70 ms would be preferable in that it would permit the issue of the present invention to be attained with a reserve, and a duration above 100 ms would be still better.

Since excess power operation takes place in range U in which the current is at least 70% of simulated lamp current Iao' at point A, this may be implemented by adding the function of controlling simulated lamp current Ia' so that the power supply device reaches the original predetermined rated power Pas only while it resides in range U in which the current is at least 70% of simulated lamp current Iao' at point A. Since this excess power operation is inappropriate for safe operation of lamps and power supply devices, long-term continuation beyond the necessary duration should be avoided. In fact, a duration of 300 ms would be adequate.

Concretely, the power supply device for electric discharge lamps shown in FIGS. 5 and 6 to implement the invention in this implementation mode would be designed so that duration Tu of control so that the current recovers to at least 70% of simulated lamp current Iao' immediately preceding rapid increase in the impedance of high-pressure mercury vapor discharge lamp 1 exceeds 50 ms when the impedance of high-pressure mercury vapor discharge lamp 1 rapidly increases in the operational state in which the simulated lamp current Ia' is controlled so as not to exceed maximum current Ias. For example, it would be designed so that resistor 41 has great resistance and/or capacitor 45 has great electrostatic capacitance, and the response of error integrator 46 would be designed to reach a lower speed in order to control rated power Pas.

A third implementation mode of the invention pursuant to the invention is explained next using FIGS. 11 and 12.

Figure 11:
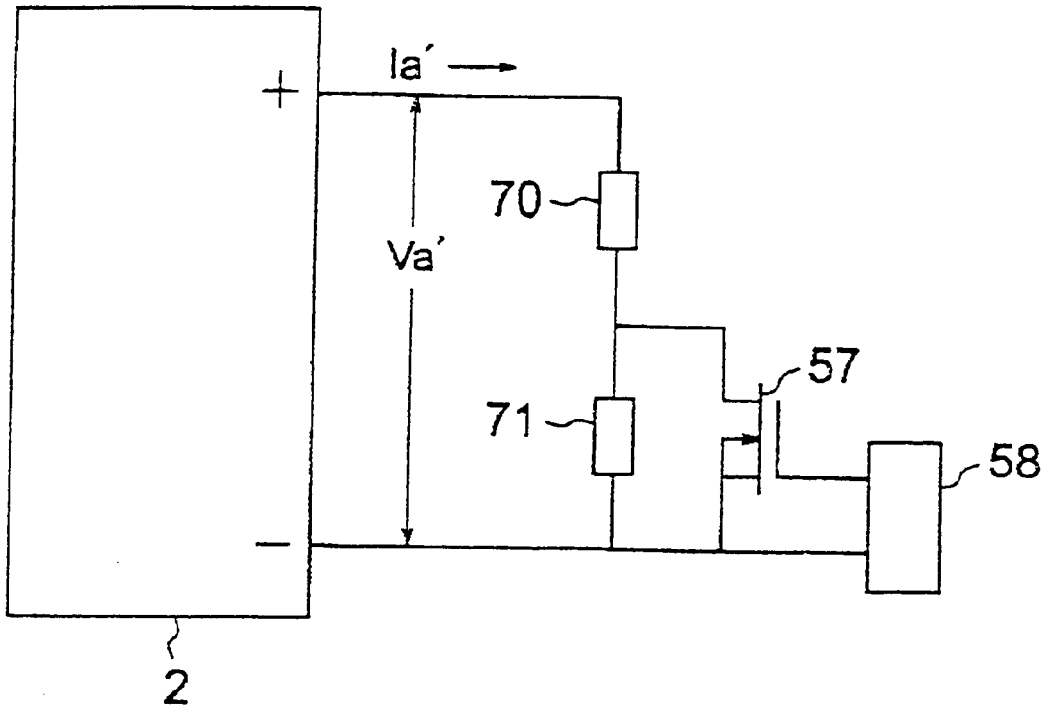
FIG. 11 is a diagram that shows the test circuit for identifying the power supply device for electric discharge lamps used in the high-pressure mercury vapor lamps pursuant to the third implementation mode.

FIG. 11 is a diagram showing a test circuit for detecting a power supply device for electric discharge lamps in which the lamp does not extinguish. Such a device is used in high-pressure mercury vapor lamps with a comparatively large amount of mercury sealed within so that 0.15 mg or more of mercury per 1 $mm^3$ volume of discharge space and $1\times10^{-7}$ moles of halogen per 1 $mm^3$ of said discharge space are sealed within.

The inventors in the present invention discovered that lamp extinguishing could be effectively prevented by this power supply device for electric discharge lamps when the device satisfies the conditions presented below through this test circuit.

The high-pressure mercury vapor lamp used in this implementation mode is explained on the assumption that arc discharge resistance Ra during arc discharge of 5ζ and glow discharge resistance Rb during glow discharge of 300ζ are used, just as in the first implementation mode. In this diagram, reference numbers 70 and 71 denote resistors of 5ζ and 300ζ resistance that are connected in series to the output terminal of power supply device 2 for electric discharge lamps. The other structures are identical with those in the structure shown in FIG. 2 designated by the same notation and are omitted.

Here, resistor 70 is set to a value equal to arc discharge resistance Ra during arc discharge so that roughly the same current as the current flowing during arc discharge when liquid mercury is present on the cathode of an actual high-pressure mercury vapor lamp flows through resistor 70, and resistor 70+resistor 71 are set to a value equal to glow discharge resistance Rb so that roughly the same current as the current flowing during glow discharge of a high-pressure mercury vapor lamp flows through resistors 70, 71.

Figure 12:
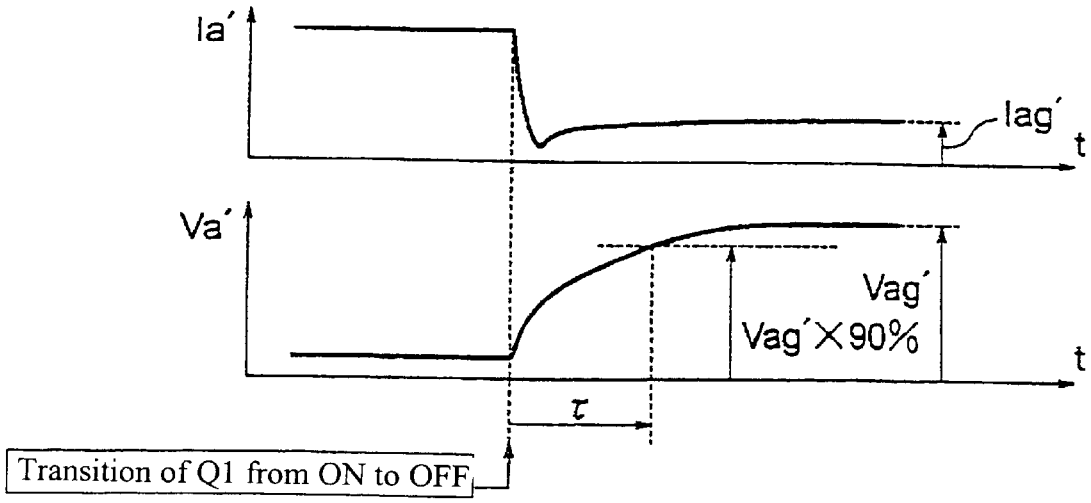
FIG. 12 are plots that show the characteristics of simulated lamp power Ia', simulated lamp voltage Va' in the test circuit shown in FIG. 11 of the power supply device for electric discharge lamps that satisfies prescribed conditions and does not extinguish.

FIG. 12 shows plots of the periodic change in simulated lamp current Ia' and simulated lamp voltage Va' when the state is switched from connection only of resistor 70 to serial connection of resistor 70 and resistor 71.

In this implementation mode, the discovery was made that extinguishing could be prevented even when power supply device for electric discharge lamps 2 uses high-pressure mercury vapor lamps if the individual conditions presented below are satisfied while simulated arc current flows through resistor 70 when only resistor 70 is connected to the output terminal of power supply device 2 for electric discharge lamps that is the object of evaluation wherein the cathode surface area is Sc ($mm^2$)

(1) The simulated glow discharge current Iag' in the steady state following switching from resistor 70 to resistor 70+resistor 71 is Iag'/0.14×Sc (A)

(2) The output voltage of the power supply device for electric discharge lamps in the steady state following switching from resistor 70 to resistor 70+resistor 71 is Vag'/180 (V)

(3) The time required for the output voltage Vag' in the steady state to reach 90% of the voltage in the steady state following switching from resistor 70 to resistor 70+resistor 71 is time τ*170 (μs).

This cathode surface area is the surface area of the entire electrode having a cathode effect that is exposed in the discharge space.

The reason that the capacity to provide simulated glow discharge current Iag' in the steady state should increase proportionally to the cathode surface area Sc is that discharge takes place over the entire cathode surface in glow discharge, in contrast to arc discharge. If the capacity to provide current whose size is proportional to the cathode surface area is lacking, the electrode surface could not be heated enough to permit transition to arc discharge due to thermion release. A capacity to provide simulated glow discharge current of Iag'/0.016×Sc would be more desirable.

The reason that the capacity is required to provide more than 180 V as simulated glow voltage Vag' in the steady state is that voltage exceeding 180 V would be required for glow discharge, almost independently of the gas pressure or the separation between the cathode and anode, if the amount of halogen that is sealed exceeds $1\times10^{-7}$ moles per 1 $Mm^3$ of discharge space in electric discharge lamps in which are sealed noble gases such as mercury or argon and halogens such as bromine.

The ability to provide Vag'/200 V as output voltage Vag' would be more desirable.

The reason that time τ required for output voltage Vag' to reach 90% of the voltage in the steady state should be under 170 μs is that glow discharge could not be maintained and discharge would be discontinued if the time were longer. By the time the voltage had subsequently risen adequately, the electrode would already have cooled, resulting in a high probability of the lamp extinguishing. Time τ*100 μs would be more desirable.

Experiments of the inventors revealed that the extinguishing rate falls completely to 0% if Iag' 0.4A in a lamp using a cathode whose surface area is about 25 $mm^2$ at Vag' 200 V, τ 100 μs.

Even if the performance should fall to Vag' 180 V, τ 170 μs, Iag' 0.35A, the extinguishing rate would be under 1%, which is practical enough.

The fourth implementation mode of the invention of this claim is explained next using FIGS. 13 and 14.

Figure 13:
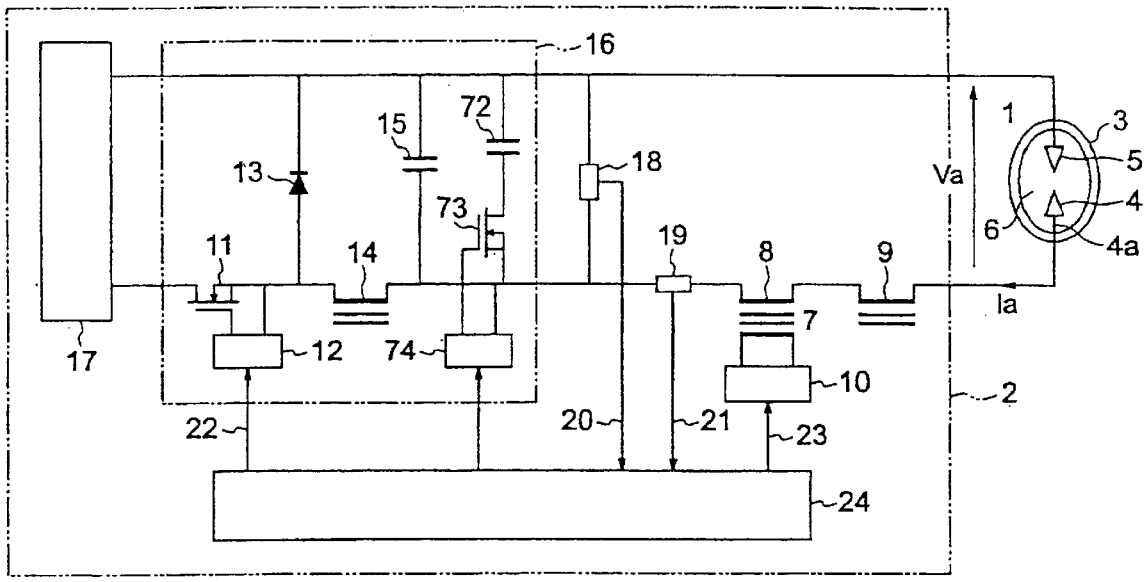
FIG. 13 is a circuit diagram that shows the structure of the power supply device for electric discharge lamps pursuant to the fourth implementation mode.

FIG. 13 is a diagram that shows the structure of the power supply device for electric discharge lamps pursuant to this implementation mode.

In this diagram, reference number 72 denotes a smoothing capacitor 72 that is mounted to permit parallel connection with smoothing capacitor 15, 73 denotes a FET that switches insertion/removal of smoothing capacitor 72, and 74 denotes a gate drive circuit that switches FET 73. The other structures are identical with those in the structure shown in FIG. 5 designated by the same notation and are omitted.

Figure 14:
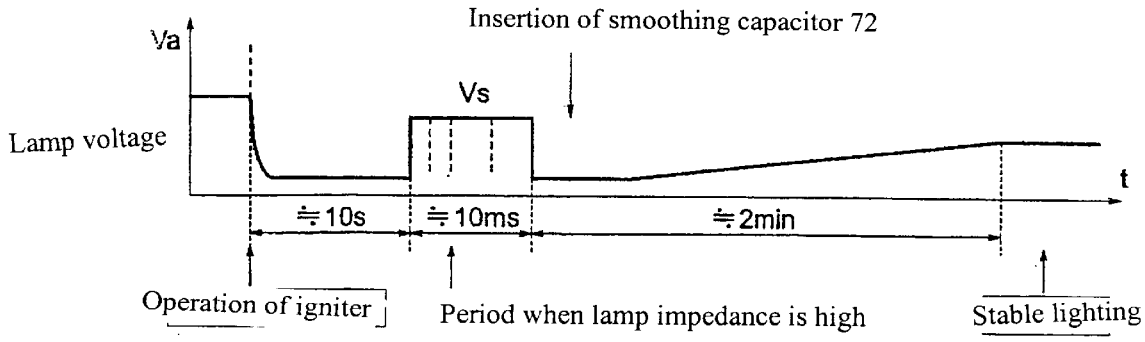
FIG. 14 is a graph that shows the periodic details of lamp voltage Va of a high-pressure mercury vapor lamp pursuant to the fourth implementation mode.

FIG. 14 is a of the periodic details of lamp voltage of a high-pressure mercury vapor lamp pursuant to this implementation mode when a high-pressure mercury vapor lamps is first lit.

After the period of great impedance during lamp glow discharge has elapsed, in this implementation mode, as shown in FIG. 13, smoothing capacitor 15 and FET 73 in parallel turn ON and the capacitance of the smoothing capacitor is increased by inserting smoothing capacitor 72.

Reducing the electrostatic capacitance of smoothing capacitor 15 to a range such that ripples of smoothing capacitor 15 do not become excessive was explained to be useful in explaining the power supply device for electric discharge lamps shown previously in FIG. 5, but by maintaining a small capacitance of the smoothing capacitor until the transition to thermal arc discharge, lamp damage could be prevented through suppression of the charge released to the lamp from a smoothing capacitor in sudden transition to arc discharge during glow discharge. On the other hand, ripples readily develop if the smoothing capacitor is small, and that creates acoustic resonance which leads to lamp flickering and extinguishing.

In light of said problems, the invention of this implementation mode prevents lamp flicking and extinguishing due to said acoustic resonance by turning on FET 73 after the transition to thermal arc discharge following elapse of a period of high impedance during glow discharge, whereupon smoothing capacitor 15 and smoothing capacitor 16 are connected in parallel to increase the capacitance of the smoothing capacitor, as shown in FIG. 14.

In accordance with the invention, lamp extinguishing when mercury has completely evaporated from the cathode at the start of lighting can be prevented when using high-pressure mercury vapor lamps with a comparatively large amount of mercury sealed within, and lamp flickering and extinguishing due to acoustic resonance after transition to thermal arc discharge following the elapse of a period of high lamp impedance can be prevented.

Industrial Field of Invention

The present invention can be used in a power supply device for electric discharge lamps to light high-luminance high-pressure mercury vapor lamps that are used as the light source in projectors, for example.

What is claimed is:

1. A power supply device for lighting electric discharge, high pressure mercury vapor lamps having an arc discharge resistance during arc discharge and a glow discharge resistance during glow discharge, comprising:

a cathode and an anode disposed in a discharge space which is enclosed by an inclusion body in which noble gas as well as at least 0.15 mg of mercury per 1 $mm^3$ of said discharge space are sealed, a power supply;

a simulated arc discharge resistor having a resistance which is virtually equal to the arc discharge resistance during said arc discharge, said simulated arc discharge resistor being connected to the power supply;

simulated glow discharge resistors having virtually 1/7 of the glow discharge resistance occurring during said glow discharge;

an output terminal, and a switchable connection, the switchable connection being arranged to switch a connection of the simulated arc discharge resistor to the output terminal to a connection of said simulated glow discharge resistors to the output terminal in a manner causing a simulated glow discharge current, in a transient state of switching from a state of flow of simulated arc discharge current, to be under 30% of said simulated arc discharge current for less than 10 $\mu$s and then to current recover to at least 70% of said simulated arc discharge current in less than 100 $\mu$s.

2. The power supply device for electric discharge lamps of claim 1, wherein the power supply is a variable output direct current power source that inputs direct current voltage and then applies a variably-controlled output voltage to said high-pressure mercury vapor lamps via a smoothing capacitor;

wherein said smoothing capacitor has a capacitance which is increased during transition to arc discharge following the end of glow discharge.

3. The power supply device for electric discharge lamps of claim 2, further comprising means for controlling lamp current so that lamp power reaches a predetermined rated power and does not exceed a predetermined maximum current in a manner giving priority to preventing of the lamp current from exceeding said maximum current over reaching said rated power and in a manner causing the current to recover at least 70% of said simulated arc discharge current during a time period of more than 50 ms from switching to said simulated glow discharge resistor for enabling exceeding of said rated power to be tolerated.

4. The power supply device for electric discharge lamps of claim 1, further comprising means for controlling lamp current so that lamp power reaches a predetermined rated power and does not exceed a predetermined maximum current in a manner giving priority to preventing of the lamp current from exceeding said maximum current over reaching said rated power and in a manner causing the current to recover at least 70% of said simulated arc discharge current during a time period of more than 50 ms from switching to said simulated glow discharge resistor for enabling exceeding of said rated power to be tolerated.

5. A power supply device for electric discharge, high pressure mercury vapor lamps having an arc discharge resistance during arc discharge and a glow discharge resistance during glow discharge, comprising a cathode and anode disposed in a discharge space enclosed by an inclusion body and in which noble gas, 0.15 mg or more of mercury per 1 $mm^3$ of said discharge space and $1\times10^{-7}$ moles of halogen per 1 $mm^3$ of said discharge space are sealed in said discharge space, a power supply;

a simulated arc discharge resistor having a resistance which is virtually equal to the arc discharge resistance during said arc discharge, said simulated arc discharge resistor being connected to the power supply;

simulated glow discharge resistors having virtually 1/7 of the glow discharge resistance occurring during said glow discharge;

an output terminal, and a switchable connection, the switchable connection being arranged to switch a connection of the simulated arc discharge resistor to the output terminal to a connection of said simulated glow discharge resistors to the output terminal; wherein:

(1) the simulated glow discharge current in steady state is Iag' 0.14×Sc (A), (2) the output voltage in the steady state is Vag' 180 (V), and (3) the time required for the output voltage Vag' to reach 90% of the voltage in steady state is $\tau \leqq 170$ ($\mu$s), where Vag' represents the output voltage of the power supply, Iag' represents the simulated glow discharge current upon switching to said simulated glow discharge resistor from the state of flow of simulated arc discharge current by connecting said simulated arc discharge resistor to the power supply, and Sc ($mm^2$) represents cathode surface area.

6. The power supply device for electric discharge lamps of claim 5, wherein the power supply is a variable output direct current power source that inputs direct current voltage and then applies a variably-controlled output voltage to said high-pressure mercury vapor lamps via a smoothing capacitor;

wherein said smoothing capacitor has a capacitance which is increased during transition to arc discharge following the end of glow discharge.

* * * * *

UNITED STATES PATENT AND TRADEMARK OFFICE

CERTIFICATE OF CORRECTION

PATENT NO. : 6,376,998 B2 
DATED : April 23, 2002
INVENTOR(S) : Masashi Okamoto et al.

It is certified that error appears in the above-identified patent and that said Letters Patent is hereby corrected as shown below:

Title page,
Item [75], Inventors, delete "Yoshitaru Kondo" add -- Yoshiteru Kondo --.

Signed and Sealed this

Eighteenth Day of February, 2003

JAMES E. ROGAN
*Director of the United States Patent and Trademark Office*